US006164444A

United States Patent [19]

Bray et al.

[11] Patent Number: 6,164,444

[45] Date of Patent: Dec. 26, 2000

[54] PACKAGING FOR SMOKING ARTICLES WITH SEALED ENCLOSURE

[75] Inventors: Andrew Jonathan Bray, Milton Keynes; Michael Patrick Parker, Leighton Buzzard; John Roger Sampson, Welwyn Garden; Adrian Roy Stewart-Cox, Buckingham, all of United Kingdom

[73] Assignee: British American Tobacco Investments Ltd., London, United Kingdom

[21] Appl. No.: 09/284,987

[22] PCT Filed: Nov. 19, 1997

[86] PCT No.: PCT/GB97/03183

§ 371 Date: May 12, 1999

§ 102(e) Date: May 12, 1999

[87] PCT Pub. No.: WO98/22367

PCT Pub. Date: May 28, 1998

[30] Foreign Application Priority Data

| | | | |
|---|---|---|---|
| Nov. 21, 1996 | [GB] | United Kingdom | 9624275 |
| Aug. 6, 1997 | [GB] | United Kingdom | 9716699 |
| Oct. 3, 1997 | [GB] | United Kingdom | 9721080 |

[51] Int. Cl.[7] ..... B65D 85/10; B65D 85/12; B65D 43/16

[52] U.S. Cl. ..... 206/268; 206/264; 206/273; 229/160.1

[58] Field of Search ..... 206/242, 264, 206/268, 269, 271, 273, 274, 275; 229/160.1

[56] References Cited

U.S. PATENT DOCUMENTS

| | | | |
|---|---|---|---|
| 1,755,579 | 4/1930 | Grupe . | |
| 1,877,955 | 9/1932 | Ottinger | 206/268 X |
| 2,719,663 | 10/1955 | Meyer-Jagenberg . | |
| 2,896,839 | 7/1959 | Barnes et al. . | |
| 3,027,998 | 4/1962 | Ridgeway . | |
| 3,999,655 | 12/1976 | Molins et al. . | |

(List continued on next page.)

FOREIGN PATENT DOCUMENTS

| | | |
|---|---|---|
| 0119314A2 | 9/1984 | European Pat. Off. . |
| 378 586 B1 | 7/1989 | European Pat. Off. . |
| 0447636B1 | 12/1990 | European Pat. Off. . |
| 0546369A1 | 11/1992 | European Pat. Off. . |
| 633202 A2 | 1/1995 | European Pat. Off. . |
| 789627 | 1/1958 | United Kingdom . |
| 918388 | 8/1959 | United Kingdom . |
| 1514174 | 6/1978 | United Kingdom . |
| 2140774 | 8/1983 | United Kingdom . |
| 2264483 | 9/1993 | United Kingdom . |
| WO 87/02645 | 5/1987 | WIPO . |

*Primary Examiner*—Bryon P. Gehman
*Attorney, Agent, or Firm*—Jones, Tullar & Cooper, PC

[57] ABSTRACT

A pack (1) for smoking articles such as cigarettes has a sealed enclosure of barrier material, with a resealable access aperture to the enclosure. A cover (7) over that aperture has on all its openable edges a permanently tacky surface overlapping over the barrier material there. The cover has a non-adhesive tab (10) to assist opening. An inner frame provides support to the barrier material adjacent to the aperture, allowing the adhesive cover to be pressed firmly against the barrier layer to aid resealing. The pack may be provided with or without an outer carton. If an outer carton is included, the carton may be of a generally rigid card material, and may have a flip-top configuration, may be a Laubé box, or may have a shell-and-slide configuration.

An inner frame provides support to the barrier material adjacent to the aperture, allowing the adhesive cover to be pressed firmly against the barrier layer to aid resealing. The pack may be provided with or without an outer carton. If an outer carton is included, the carton may be of a generally rigid card material, and may have a flip-top configuration, may be a Laubé box, or may have a shell-and-slide configuration.

17 Claims, 16 Drawing Sheets

U.S. PATENT DOCUMENTS

| | | | |
|---|---|---|---|
| 4,119,196 | 10/1978 | Flaherty . | |
| 4,300,676 | 11/1981 | Focke et al. | 206/264 |
| 4,420,080 | 12/1983 | Nakamura . | |
| 4,606,956 | 8/1986 | Charbonneau et al. . | |
| 4,632,299 | 12/1986 | Holmberg . | |
| 4,679,693 | 7/1987 | Forman . | |
| 4,720,423 | 1/1988 | Fraser . | |
| 4,763,779 | 8/1988 | Focke et al. . | |
| 4,771,882 | 9/1988 | Lowe et al. | 206/268 |
| 4,771,891 | 9/1988 | Sorenson et al. . | |
| 4,784,261 | 11/1988 | Kutchin . | |
| 4,850,482 | 7/1989 | Campbell | 206/273 |
| 5,029,712 | 7/1991 | O'Brien et al. . | |
| 5,096,113 | 3/1992 | Focke . | |
| 5,125,211 | 6/1992 | O'Brien et al. . | |
| 5,158,664 | 10/1992 | Colgan et al. | 206/242 |
| 5,249,676 | 10/1993 | Ashcraft et al. . | |
| 5,333,729 | 8/1994 | Wolfe . | |
| 5,333,735 | 8/1994 | Focke et al. . | |
| 5,511,658 | 4/1996 | Focke et al. . | |
| 5,556,026 | 9/1996 | Blankitny . | |

PACKAGING FOR SMOKING ARTICLES WITH SEALED ENCLOSURE

BACKGROUND OF THE INVENTION

This invention relates to packaging for smoking articles such as cigarettes, cigars and cigarillos. For convenience and brevity these will be referred to herein as cigarettes.

The object of the present invention is to provide packaging for cigarettes which acts as an effective barrier against ingress and egress of humidity or ingress of contaminants during transport and storage of the packaged cigarettes, but which also allows maintenance of that effective barrier property even after the package has been first opened by the user. In other words, we are providing a resealable barrier layer in cigarette packaging.

The provision of barrier layers either as an inner wrap of a cigarette carton or an outer wrap or both is commonplace. Provision is more or less essential if cigarettes are to have any sort of commercial shelf life in zones having hostile climatic conditions, especially in high temperature, high humidity zones.

But as far as we are aware all such barrier layers so far provided, whether internal or external, have been destroyed in their barrier function when the user first opens the package. Typically, an outer barrier layer has a tearstrip which the user operates to separate halves of the outer wrap which is then discarded, or a barrier layer within a cigarette carton (or surrounding a soft wrap package) although not usually discarded once the package is opened has a permanent opening formed in it by the user when he first gains access.

U.S. Pat. No. 4,763,779 shows a tin-foil inner wrapping for a Laubé-type box where a flap of that wrapping may be brought down over an access aperture, and overlap the edges of the aperture. It may have a "peel-seal" connection to the edges it overlaps.

SUMMARY OF THE INVENTION

In the present invention we provide a resealable sealed barrier layer by defining in the barrier layer an access aperture extending from an end wall into a major face of a cuboid pack, there being over the aperture and extending beyond all of its openable edges a cover layer having a permanently tacky surface engageable with the barrier material adjacent to the edges of the aperture. The cover layer will usually be a discrete layer applied to the barrier layer.

The aperture may be defined by lines of weakening in the unopened package, not penetrating through the thickness of the material, or by actual cuts, with or without interruptions. The aperture in the barrier layer will preferably be defined by the line or lines of weakening or cuts and by an unweakened or uncut edge, this forming a hinged flap of the barrier material.

The cover layer with a permanently tacky surface may itself be formed of barrier material, even if discrete from the main body of such material, but it may be quite satisfactory to use for that purpose a paper or other sheet material which preferably will be continuous from edge to edge, that is to say, across the whole extent of the aperture in the barrier layer plus its overlapping edges.

The layer may be in the form of a label, a coupon or an excise stamp, for example.

The preferred material of the barrier layer will either be a plastics/metal foil laminate or a metallized plastics material since either of these offer outstandingly good barrier properties.

The barrier layer be continuous over one minor end of the pack or charge, and have side seams along both minor sides of the pack and an envelope or similar fold over the opposite minor end. The barrier layer need not be applied in that manner—it can equally well be applied so as to be continuous over one minor side and sealed over both minor ends and one minor side.

Various patterns of heat sealable portions of barrier layer, achieved by the application of glue, lacquer or the like to the barrier material, can when heat-sealed with each other or with the barrier material form an enclosure which is as near as possible hermetic.

It is desirable that a non-adhesive tab is present at one edge of the cover layer, to aid opening and reopening of the pack.

It is preferable that the tab does not lie flush with the barrier layer, so that it may be more easily gripped when opening/reopening the pack. This may be achieved by various means, for example by folding in the region where the tab joins the adhesive portion of the cover, by applying inks or other media which upon drying distort the material of the cover, or by distorting the cover by embossing. More preferably, the tab is folded back to lie against (the non-adhesive surface of) the cover and then releasably held in place by minor amounts of an adhesive.

A resealable pack may be included in a Laube, or flat, box. Such boxes are well know in the art and are generally rigid, being made of thick card or similar material, and hinged along a minor edge of a major face, or along a major midline of a minor face. In such embodiments, the aperture in the barrier layer is preferably located on the front surface of the pack (that is, the major surface that is revealed when the Laubé box is opened) and the top surface (that is, the surface which is furthest from the hinge of the Laubé box). It may be desirable for the cover to have a tab at the top of the pack, which tab may be arranged to protrude between the lips of the Laubé box. The barrier layer may be placed around the bundle of cigarettes either to produce a side-seamed enclosure or one seamed over the front and/or back major faces of the bundle.

Furthermore, flavourant may be provided in the permanently tacky adhesive used for resealing the barrier layer. Thus, a quantity of the flavourant will be released each time the cigarettes are accessed. This contrasts with previously known systems (such as described in U.S. Pat. No. 5,249,676) which release only a single burst of flavourant, on initial opening of the packaging.

In the present invention, the flavourant is preferably micro-encapsulated, each action of disengaging the tacky surface from the barrier layer causing a proportion of the micro-capsules to be ruptured, and so release their contents. U.S. Pat. No. 4,720,423, again relating to a one-off flavourant release system, describes how flavourant-bearing micro-capsules may be incorporated into adhesive.

By flavourant is meant any substance which releases, produces, neutralises, masks or alters odours, for example a perfume or deodorant.

Flavourant may alternatively or additionally be incorporated into an integer which is included within the cigarette packaging, inside the barrier layer. The integer may be of a porous substance, for example a pad, a paper sheet or may be the card inner frame of a semi-rigid pack. Alternatively, the flavourant may be encapsulated or included in a sachet, the capsule or sachet being included within the packaging.

This flavourant may permeate the cigarettes included within the packaging, so as to affect the taste or odour of smoke produced when smoking the cigarettes. A preferred such flavourant is menthol.

Flavourant may be incorporated into both a resealable adhesive layer (outside a barrier layer) and an insert (inside the barrier layer). The flavourants may be the same, so that their effects reinforce, or different, for example to provide one flavour on opening the packaging and a different flavour in the cigarette.

We also disclose an inner frame particularly suitable for the resealable packaging of this invention. Such an inner frame has panels which are foldable relative to each other to form four at least partial faces of a cuboid including one major face, and additionally has a flap or flaps which form(s) an incomplete fifth face of the cuboid.

In a preferred configuration, the frame has a major panel, two elongate side panels and a (bottom) end panel, and two flaps. The long edges of the side panels and the end panel are the major edges and a minor edge, respectively, of the major face. The flaps are at the top ends of the side panels. Thus, upon folding, the frame forms a major face, two long side faces and a bottom end face of a cuboid, with the flaps forming two parts of an incomplete top end face.

It is preferable that the major face is not a complete rectangle, but has a recess in the top edge. When such a recess is present, it is further preferable that the end panel is shaped so that two blank, unfolded, frames placed end-to-end tessellate (i.e. can lie next to each other without overlaps or gaps) thus minimizing the amount of material needed.

The aperture in the barrier sheet through which cigarettes may be accessed preferably overlies the region between the flap(s) and the recess in the major panel of the frame. The flap(s), being supported on any cigarettes remaining in the pack (because it is preferable that the length of the side edge is similar to that of the cigarettes), provide(s) an anvil which supports the barrier layer adjacent the aperture, allowing the adhesive cover to be pressed firmly against the barrier layer, to aid resealing.

Of course, inner frames may have single folds between the panels (producing sharp edges) or double folds (producing bevelled edges). Alternatively, the sides of the frame may be rounded, for example to be used in a so-called "oval" pack.

The present invention is not limited to single bundles of cigarettes. For example, multiple bundles may be enclosed in the resealable barrier material and then inserted together into a single outer shell. Alternatively, multiple bundles, each within an inner frame, may be overwrapped together in a single pack-forming sheet, to form a semi-rigid pack containing multiple bundles.

Flavourant may be added to the packaging in the form of so-called "scratch and sniff" panels. That is, the flavourant may be coated on the packaging in a form (for example micro-encapsulated) which allows release of the flavourant when abraded. Such scratch and sniff panels are well know, for example in magazine advertisements for perfume.

The seams of the barrier layer may be formed using glue or heat-sealable strips which are added to the barrier layer for example, by being printed on. This finds particular applicability when the barrier layer is a metal/paper laminate or metallized paper. However, one or more external faces of a plastics laminate or foil may be of heat-sealable material.

BRIEF DESCRIPTION OF THE DRAWINGS

Various embodiments of the invention will now be described with reference to the accompanying drawings, wherein.

DETAILED DESCRIPTION OF THE PREFERRED EMBODIMENTS

Figure 1:
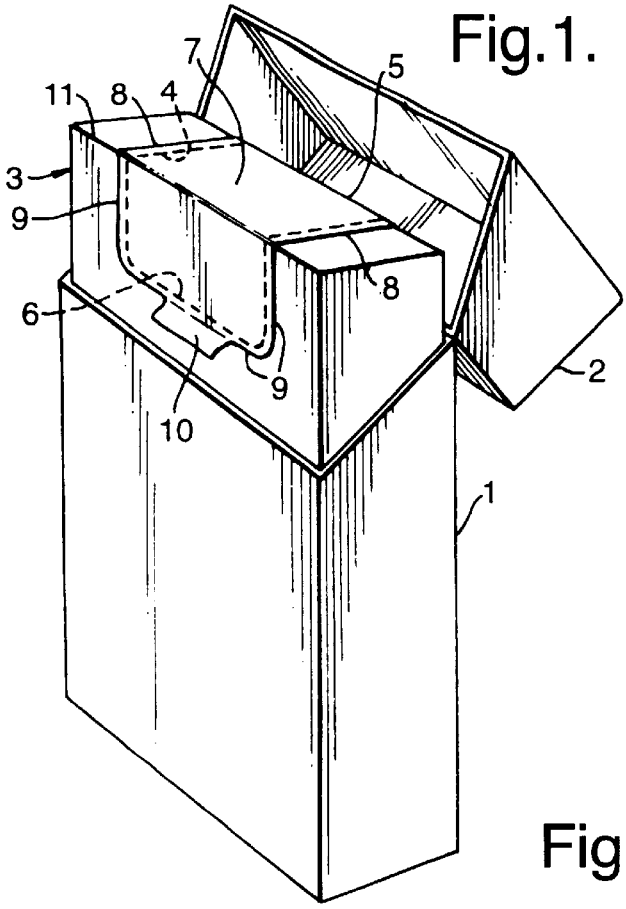
FIG. 1 is a perspective view of a generalized embodiment of the invention.

FIG. 1 shows a general embodiment with a rigid card pack 1 with a "flip-top" lid 2 containing a package 3 comprised of a charge of cigarettes overwrapped in a barrier layer. The bounds of an aperture for allowing access to the cigarettes are indicated by parallel dotted lines 4 extending from the rearside of the package 3 where a hinge line is formed on the edge 5 across the top of the package and down the front as far as a third line 6 parallel to hinge 5. As will be seen and as is clearly apparent other outer shapes of that aperture are possible; furthermore the hinge line of the lid need not be at the back of the package. The barrier layer which forms the package may be made for example of metallized plastics or of a plastics/metal foil laminate. Over its aperture lies an element, here in the form of a label 7, which is a layer of material having on its undersurface nearer to the barrier layer a permanently tacky material. The permanently tacky material may cover continuously or intermittently the whole of that undersurface, or a permanent bonding adhesive may be on the portion of the undersurface which does not overlie the edges of the barrier layer, but where the label 7 extends at edges 8 and 9 beyond the aperture edges 4 and 6 the undersurface must be provided with that permanently tacky material.

Beyond one edge of the label 7 is a tab 10 which is at least partly free of the permanently tacky material so that it may be flicked up by the user and used to pull the label to open the package.

On first use, the aperture edges 4 and 6 may have been defined by lines of weakening in the barrier material or by actual cuts. If by cuts, there preferably will be interruptions, for example aligned with front corner 11 of the package and/or in the corners between edges 4 and 6 of the aperture, so that on first lifting of the tab 11 the user feels that a separating action has occurred. The user is then free to remove cigarettes from the package through the aperture and after having done so may reseal the aperture simply by bringing down the tab so that the edge portions 8, 9 re-adhere to the adjacent portions of the barrier layer material. The flap of barrier material formed by the separation along those lines when the tab 10 was lifted is returned to its previous position and although there will now be a line of separation in that barrier layer it is covered by the adhered edges 8, 9 of the label.

To ensure as far as possible efficient adhesion an inner frame within the package offers a reaction surface underneath the barrier layer against the resealing pressure exerted on edges 8 and 9.

In the embodiments described the package 3 is a separate entity removable from the outer carton. The latter may be of any suitable type and in particular may be of the so-called "shell and slide" type wherein the package may be pressed from one end of the carton to protrude from the other for the purpose of exposing cigarettes for more ready access by the user.

Furthermore, the package above, and those to be described, may any of them be an independent entity, that is to say, may be sold without a rigid carton surrounding them, at least if, preferably, means such as a conventional clear celluloid overwrap were provided to provide further protection and prevent accidental disturbance of the tab 10. The resealable barrier layer may also be over a rigid carton.

Specific embodiments both of frames and of resealable barriers will now be described with reference to the remaining drawings. Any of these embodiments can be used in any of the contexts mentioned above and (in principle) with any other of them.

Figure 2:
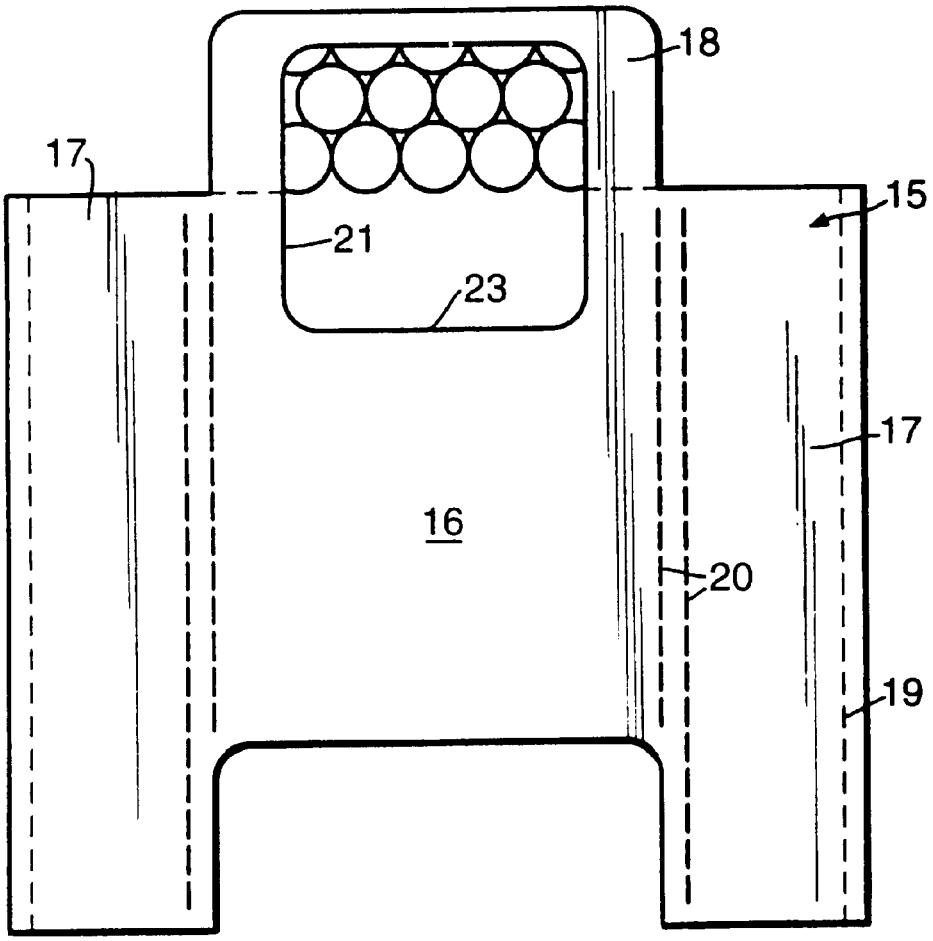
FIG. 2 shows an inner frame of a first embodiment.
Figure 3:
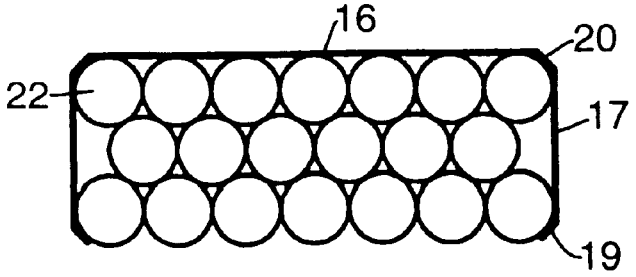
FIG. 3 is a diagrammatic end view of the inner frame of FIG. 2 assembled around a charge of cigarettes.

In FIG. 2 we see an inner frame 15 of card which has a front panel 16, two side panels 17 and a top flap 18. Score or fold lines 19, 20 form corners as seen in FIG. 3 when the side panels 17 are folded to right angles with the panel 16. Top flap 18 is also folded to right angles. It can be seen that when the inner frame has been folded for assembly in that way there is an aperture 21 formed through which most of the charge 22 of (here) twenty cigarettes will be accessible as diagrammatically indicated in FIG. 2. The aperture 21 extends to a base edge 23 in the front panel.

Figure 5:
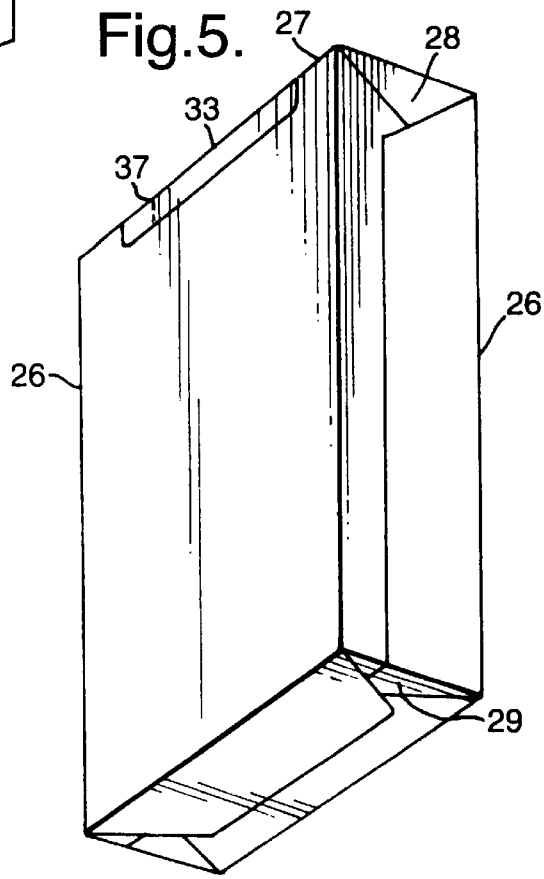
FIG. 5 is a view from behind and below of the packaging formed by that first embodiment.
Figure 4:
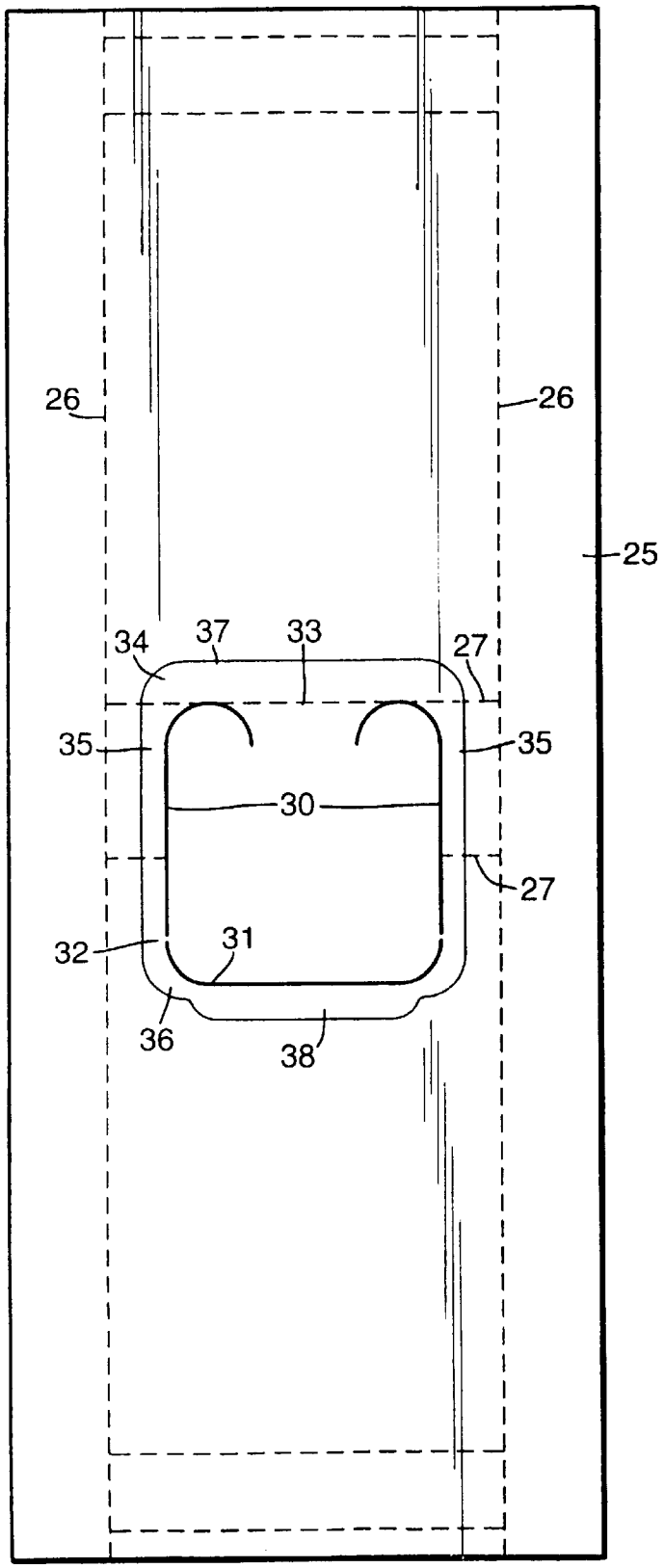
FIG. 4 is a plan view of a barrier layer and label to be wrapped around the inner frame of FIG. 2 together with its charge of cigarettes.
Figure 6:
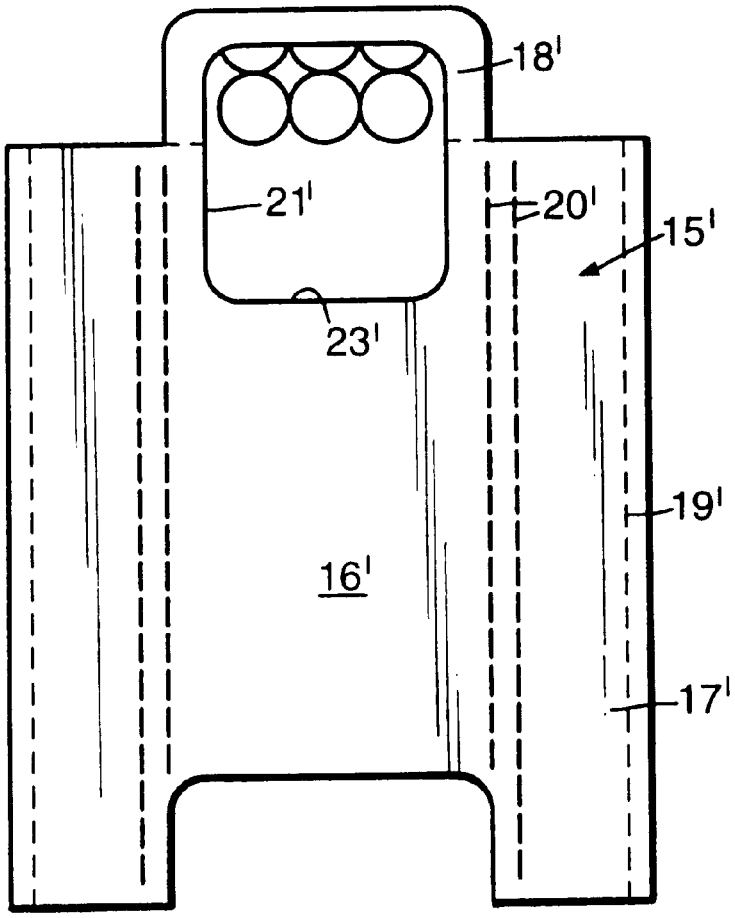
FIG. 6 is a face view of the inner frame of a second embodiment.
Figure 7:
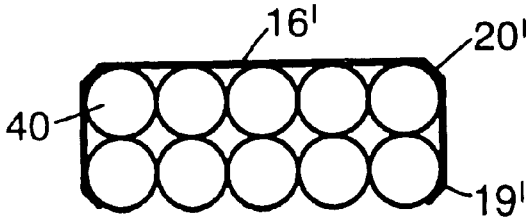
FIG. 7 is a diagrammatic end view of the inner frame of the second embodiment assembled around a charge of cigarettes.

FIG. 4 is a face view of a sheet 25 which is to form a barrier layer overwrapped around the charge of cigarettes contained in the inner frame 15. Fold lines 26 show where the sheet will be brought round to overlie side panels 17 of the frame and dotted lines 27 show where it will be brought round to overlie the top flap 18. At the bottom of the package formed around the inner frame and its charge (an operation which can be carried out on standard machines), and adjacent the top of the package diamond folds 28, 29 are formed as indicated in FIG. 5, and this and side seams are sealed in any suitable manner, as for example in reciprocating, sliding, tractor or band- or induction-sealing mechanisms.

An aperture in the barrier layer is defined by slits 30, 31. There is discontinuity between these slits at 32. The slits 30, 31 which are pre-cut through the whole thickness of the barrier material correspond to the side edges of the aperture 21 in the inner frame and to its base edge 23 in the front panel respectively. On the line 27 a hinge portion 33 is formed in an uncut area.

To maintain the flap formed by the cuts 30, 31 securely in position and to prevent all but negligible transfer of humidity through the barrier, a layer 34 is applied over the aperture formed in the barrier layer. This is in the form of a label, usually of a film of plastics material, of which the undersurface is coated with a permanently adhesive, that is to say a permanently tacky, material so that it adheres to the barrier layer and can readhere to it. In this embodiment the label extends beyond all edges of the aperture i.e. both those formed in the barrier layer by slits 30, 31 and that formed by the hinge 33, by marginal portions 35 on the sides, 36 on the bottom and 37 on the back respectively. If the slots 30 were to terminate short of line 27 it would not be necessary for portion 37 to be on the back of the package.

Beyond the portion 36 is a tab 38 which is free of the adhesive material.

As can be seen the package once made up can be inserted into a carton and used in a manner generally described in relation to FIG. 1. When the user first lifts the tab 38 he should get a distinct signal as the discontinuities 32 are severed for the first time. When he has extracted one or more cigarettes he can reseal the package by applying the edge portions 35 and bottom portion 36 once more to the surrounding barrier material, with edge portions of the frame 15 around the aperture 21 acting as an anvil against the pressure exerted. Provided that the barrier layer is correctly repositioned, something which is assisted by the hinge portion 33, the integrity of the barrier layer after opening and resealing should be as good as it was before.

In the second embodiment as seen in FIGS. 6–11 an inner frame 15' is dimensioned for a smaller charge 40 of cigarettes, here ten, but is in other respects identical to inner frame 15. Like parts have been given like reference numbers and do not need further description.

Figure 8:
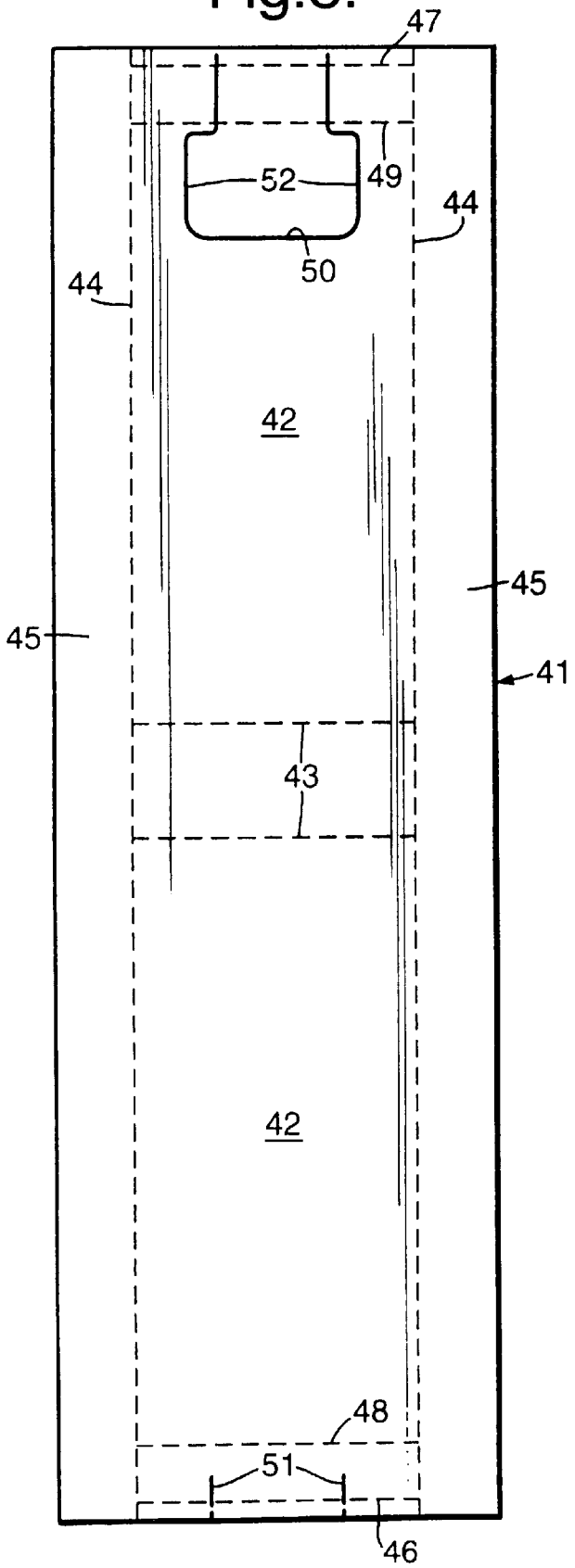
FIG. 8 is a plan view of the barrier layer of the second embodiment.
Figure 9:
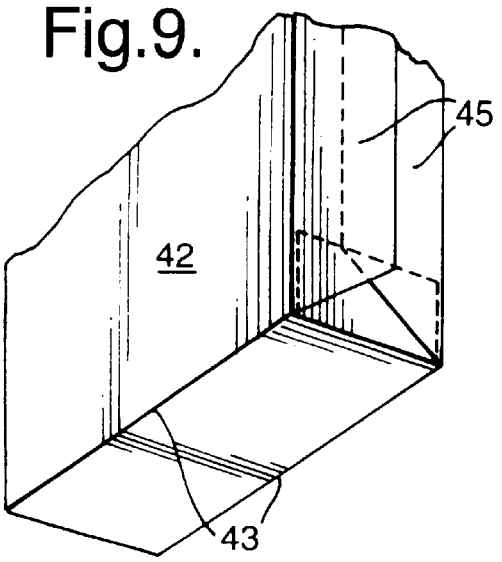
FIG. 9 is a view from behind and below of a packaging formed by the second embodiment.

The barrier layer used in the second embodiment is however different in detail, though identical in function. The sheet 41 in FIG. 8 is to be folded integrally around the base of the inner frame and charge and to be sealed only at its sides and top. It has front and back forming panels 42, lines 43 indicating where the barrier layer will turn around the base of the charge as indicated in FIG. 9.

Lines 44 indicate where side panels 45 are defined which will be sealed together in seam up each other of the formed package.

As the layer is brought around the package line 47 overlies and is brought into register with line 46, with lines 48 and 49 indicating the position of turn around the front and the back edges respectively of the top of the charge.

An aperture in the barrier layer is formed by a slit 50 in the shape of a narrow-mouthed U the legs of which extend just across lines 47. There may be discontinuities in the slit such as discontinuity 32 described with reference to the first embodiment. Discontinuous slits 51 cross the line 46. The distance between slits 51 is different from that between two parallel portions of slit 50 where the two will overlie in the assembled package (see FIG. 11). This avoids a need for exact registration of slits in the respective ends of the sheet when they are brought together in the wrapping and sealing operation.

In the front panel-forming portion 42 of the laminate the aperture defined by the slit 50 widens and parallel portions 52 correspond in position to the edges 21' of the aperture in the inner frame 15'.

Figure 10:
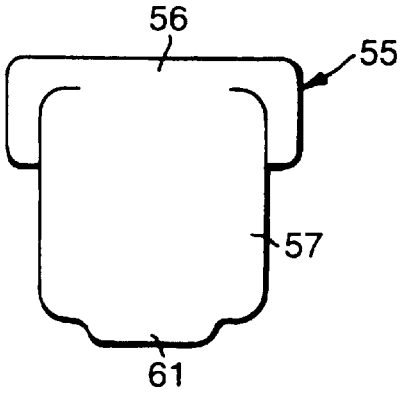
FIG. 10 is a plan view of a label of the second embodiment.

A label 55 of paper, as illustrated in FIG. 10, has an undersurface which is permanently tacky and has a base part 56 which covers over most of the upper surface of the package.

Figure 11:
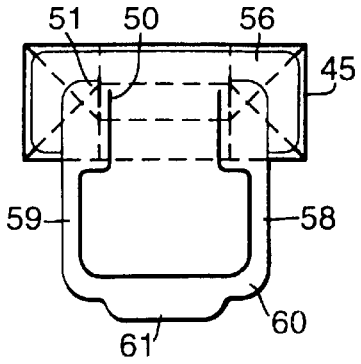
FIG. 11 indicates the assembly of that label with a top view of the barrier layer of the packaging.

A flap part 57 of the label 55 extends over and beyond the edges of the flap defined by the slit 50 in the barrier layer, providing edge portions 58, 59 and 60 for adhesion to the adjacent parts of that barrier layer as indicated in FIG. 11. As in the first embodiment there is a tab 61 free of tacky material, to assist the user's handling and resealing of the formed package.

Figure 12:
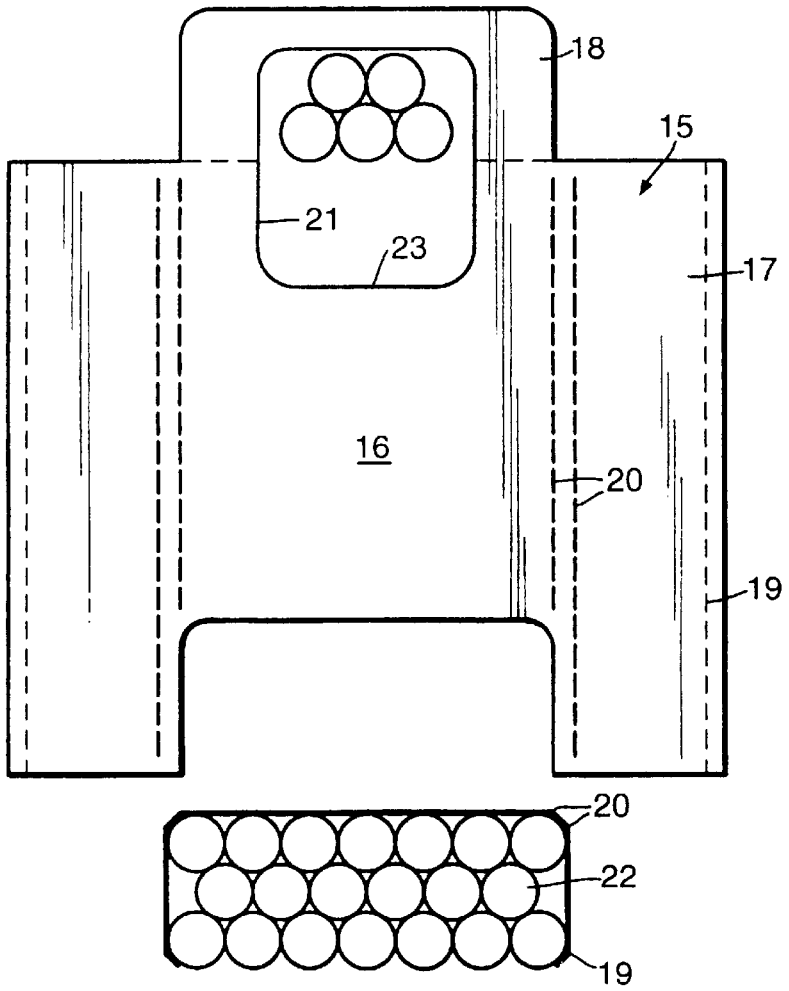
FIG. 12 shows the inner frame of a third embodiment.

In a third embodiment seen in FIGS. 12 to 15, the inner frame seen in FIG. 12 is identical with inner frame 15 of FIG. 2 and will not be described further.

Figure 13:
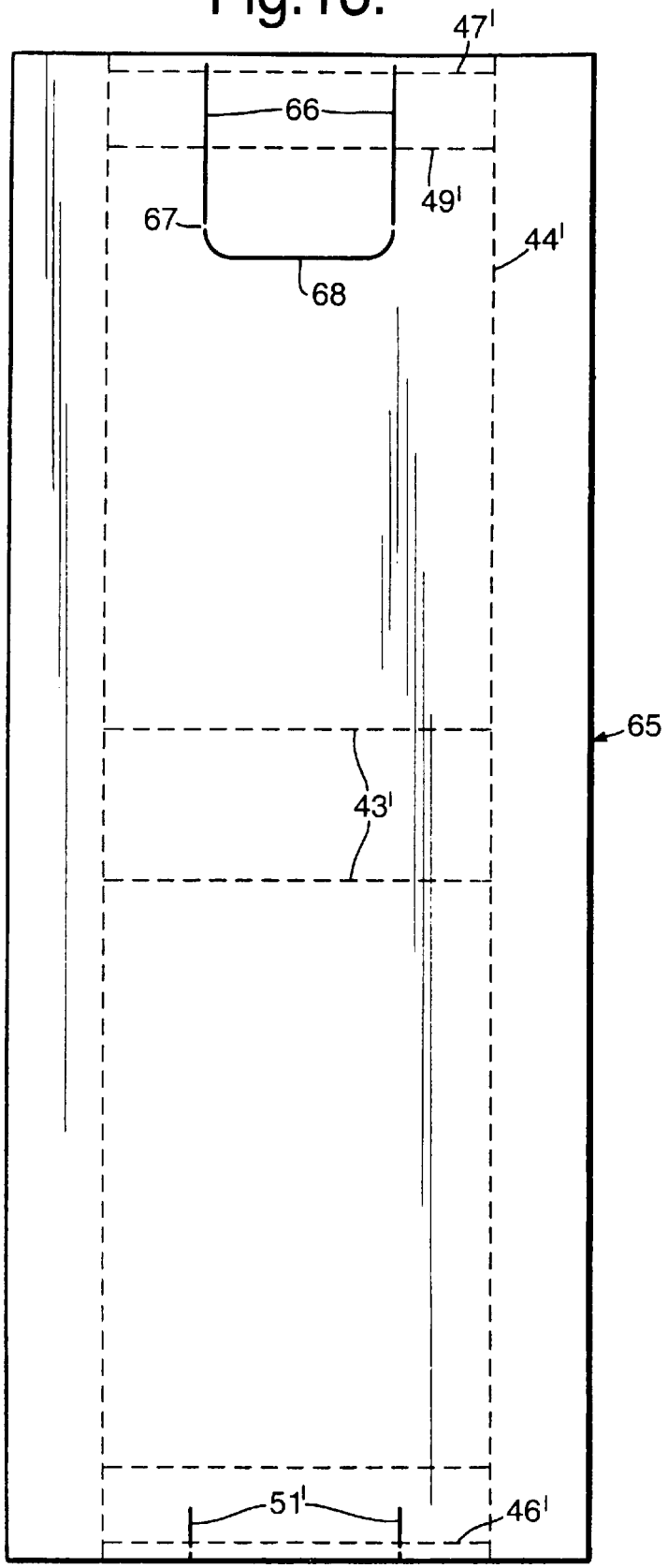
FIG. 13 shows a barrier layer for that third embodiment.

Sheet 65 seen in FIG. 13 is very similar to sheet 41 of FIG. 8 but a different conformation of slit and hence of aperture is shown. Here, an aperture for the package to be formed by this sheet is defined by parallel straight line slits 66 traversing lines 47' and 49' and which after an interruption 67 are continued into a base slit 68; the slits together defining a flap openable on a notional hinge formed by the label (FIG. 14) in the region behind lines 46'. Interrupted slits 51' traverse line 46' and are at a different spacing from lines 66.

Figure 14:
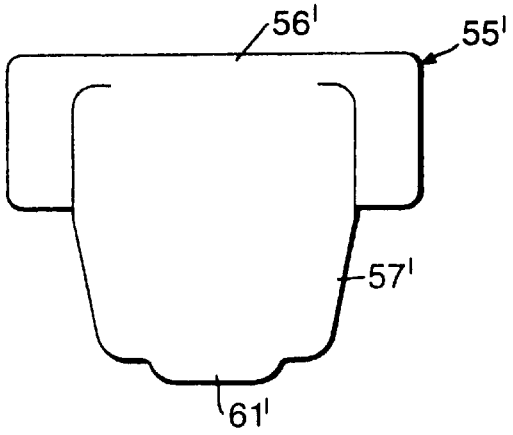
FIG. 14 is a face view of a label for the third embodiment and FIG. 15 shows an assembly of that label with a top view of the packaging of the third embodiment.
Figure 15:
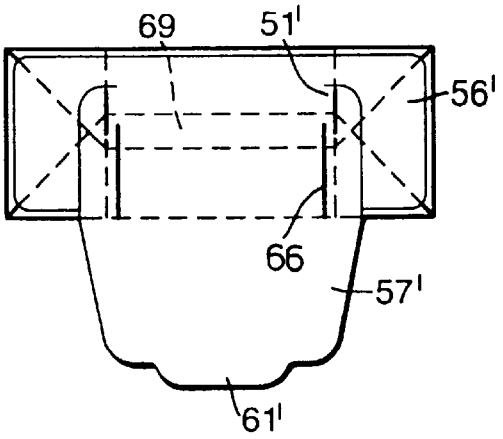

The label seen in FIG. 14 is assembled to the formed package the top of which is shown in FIG. 15: front and rear flaps of the package are sealed together in the region 69 to form effectively a single flap. An inner frame top flap (if provided) could be adhered to the barrier layer. In conformation and function the label is similar to the label described with relation to FIGS. 10 and 11 and is designated 55'.

Figure 16:
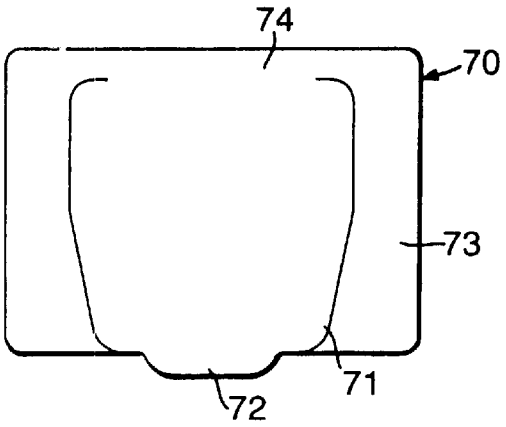
FIGS. 16 and 17 show respectively face and assembled view of fourth forms of label.
Figure 17:
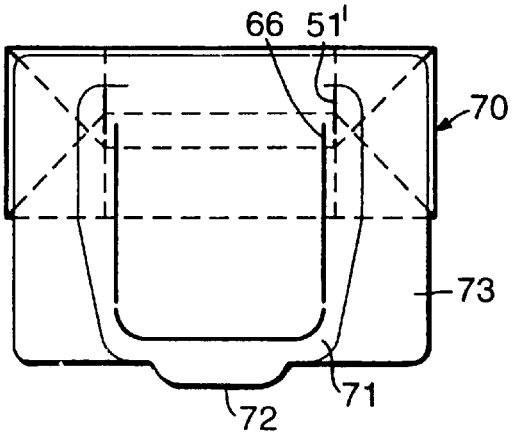

FIGS. 16 and 17 show a further conformation of label 70 suitable for any of the embodiments so far described in which, instead of a base portion such as 56 or 56' in FIGS. 10 or 14, the flap 71 here which is to cover over and extend beyond the aperture-forming portion of the barrier layer is except for its non-tacky flap 72 flanked on both sides as well as in its hinge region by permanently tacky label material 73, 74.

Labels such as those shown in FIGS. 10, 11, and 14–17 may have interruptions in the slits defining their flaps so as to provide a tamper-indicating function. Such interruptions may also assist in machine feeding of the labels.

Figure 19:
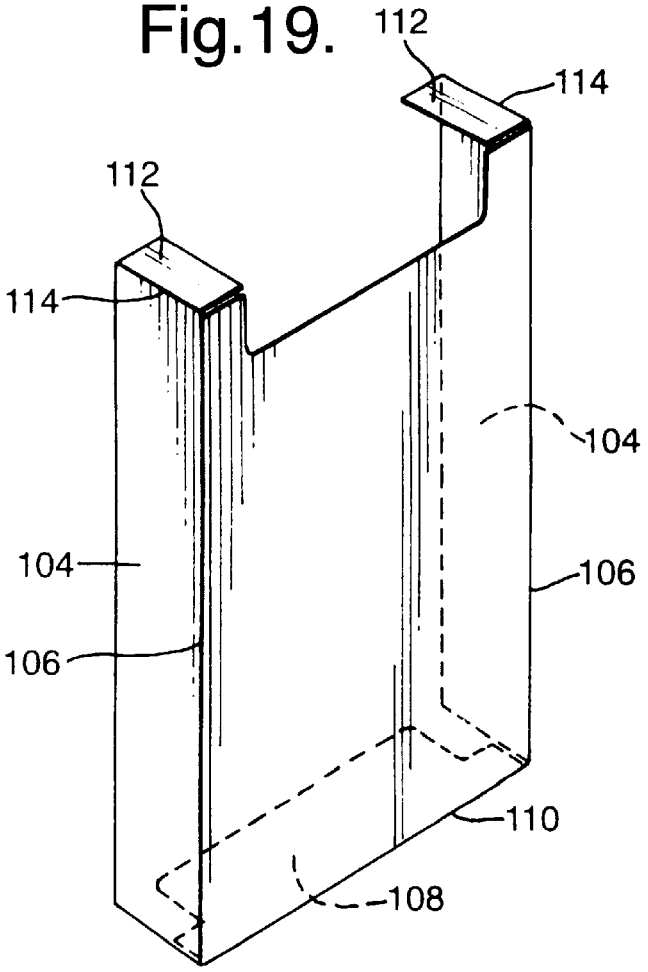
FIG. 19 shows the fourth embodiment made up, with end flaps to act as anvils against resealing pressure.
Figure 18:
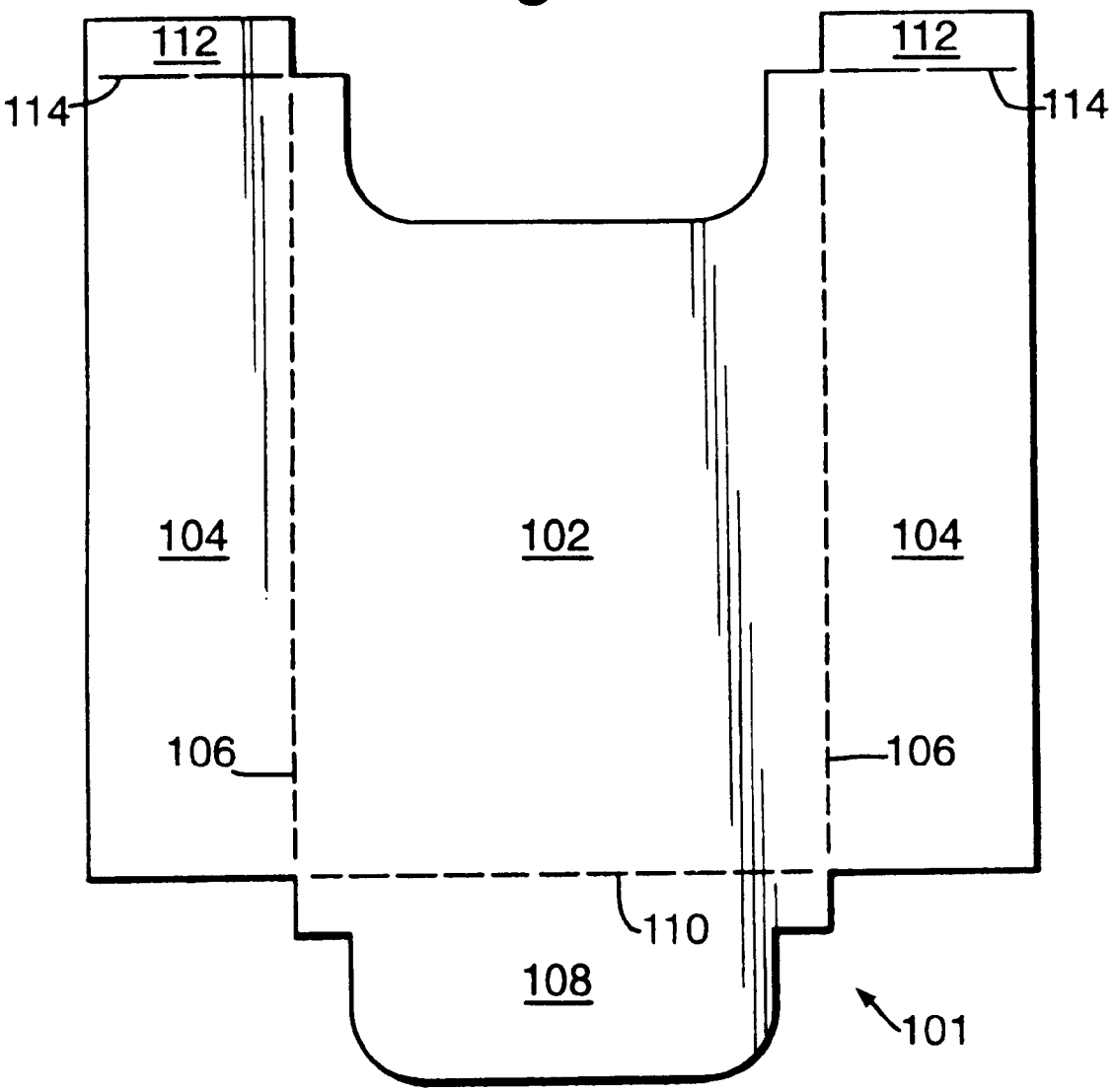
FIG. 18 shows a fourth and preferred embodiment of inner frame.

FIGS. 18 and 19 show an inner frame useable with any form of barrier layer described and has the advantage of end flaps on the top face. An inner frame 101 as shown in FIG. 18 is formed from a blank sheet of stiff card or similar foldable material. A major panel 102, which is generally rectangular, has elongate rectangular side panels 104 extending from the two major edges 106, the long edges of the side panels 104 being co-extensive with the major edges 106. A generally rectangular end panel 108 extends from a minor edge 110 (the "bottom" edge) of the major panel 102, the long edge of the end panel 108 being co-extensive with the aforesaid bottom edge 110. At the top ends of the side panels 104 are small rectangular flaps 112, which are effectively continuations of the side panels 104, along the top edges 114 of the side panels 104.

FIG. 19 shows the inner frame folded inwardly along lines 106, 110, 114, the panels 102, 104, 108 then forming four faces of a cuboid, and the flaps 112 forming two ends of an incomplete fifth face.

The major panel 102 is not a complete rectangle, it having a recess in its top edge. The bottom panel 108 is shaped to match the recess, so that, as can be seen from FIG. 18, two unfolded frames laid end-to-end would tessellate.

In the resealable semi-rigid pack the major panel 102 is at the front of the pack, with the aperture for cigarette access in the barrier layer overlaying the recess in the major panel 102 and the gap in the top face between the two flaps 112. The two flaps 112, when supported by cigarettes remaining in the pack, provide an anvil against which the adhesive cover label of the resealable barrier layer may be pressed to ensure good resealing. The length of the major edges of the major face of the major panel 102 is similar to that of the cigarettes to be contained, so that end cigarettes support, and may be gently squeezed longitudinally by, those flaps by virtue of the latter being wrapped by the barrier layer.

A flavourant-bearing integer can be included inside the barrier layer, for example a sachet, capsule or porous sheet. Alternatively the inner frame can be made of card on which is coated or in which is included a flavourant, e.g. menthol.

Microcapsules bearing flavourant can be included in the permanently tacky adhesive so that flavourant is released each time the cigarettes are accessed. A suitable adhesive is available from Sessions of York, Huntington Road, York YO3 9HS, England.

Figure 20:
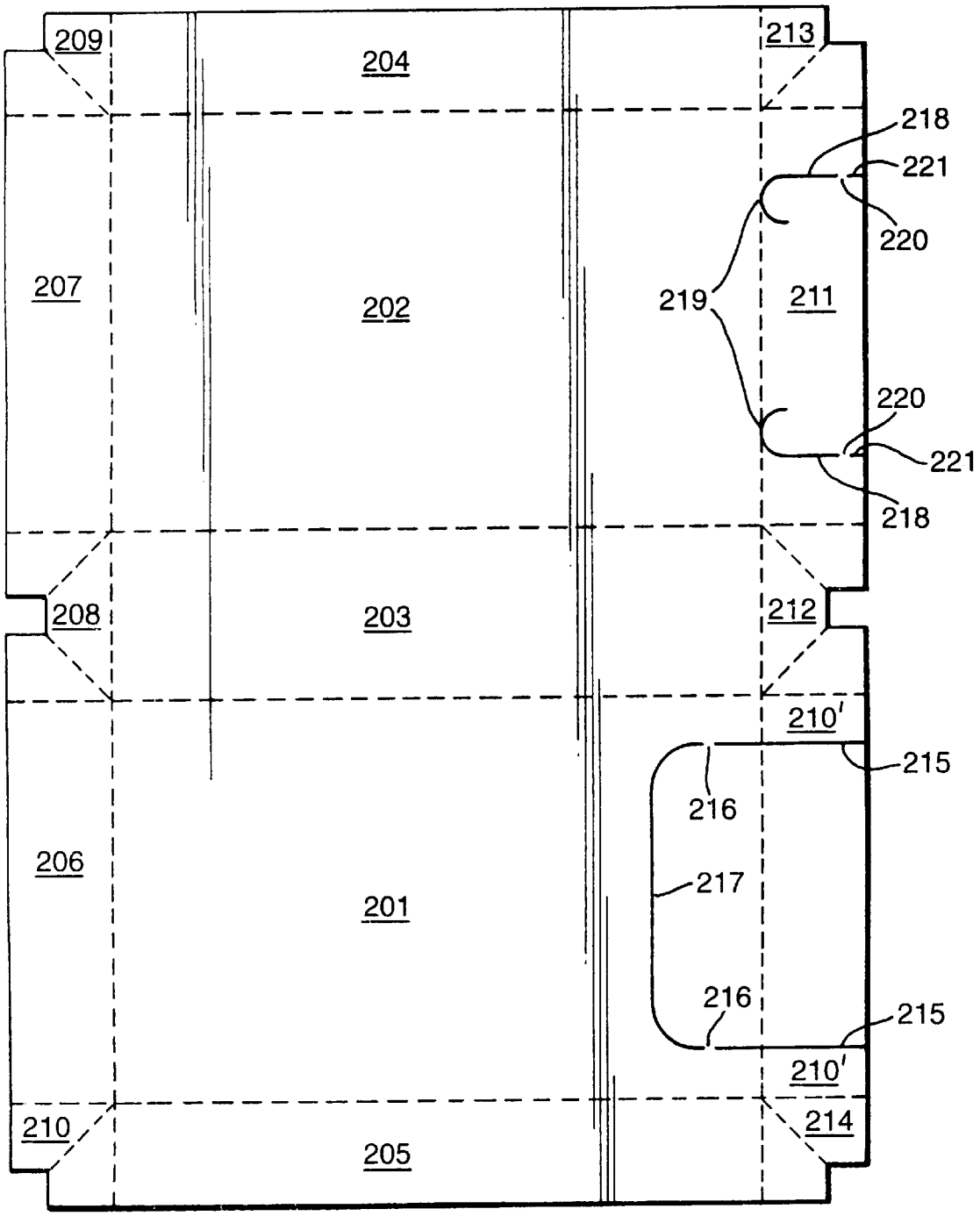
FIG. 20 shows a fourth embodiment of cut blank of barrier material.

FIG. 20 shows a cut blank for forming a barrier seal around a charge of smoking articles, usually contained in an inner frame. This blank is generally applicable in all the situations envisaged above and may be made of any of the materials mentioned there, but differs in that it is designed to be applied by folding around one minor side edge of the charge and of any inner frame rather than around one minor end.

The blank of FIG. 20 has major panels 201 and 202 which are respectively to be front and rear panels of the made-up package. An intermediate panel 203 will be continuous over one of the minor side edges of the charge. End panels 204 and 205 will overlie each other on the other of the side edges of the charge and will be heat sealed together in a seam.

To one edge of panels 201 to 205 are respective end flaps 206 and 207 on the major panels and gussets 208, 209 and 210 on the minor panels. First, end panels 206 and 207 are folded in and gussets 208, 209 and 210 are then folded out. The end panels and gussets are then sealed, usually, as with the side seam between panels 204 and 205, by heat sealing, and then the gussets are tucked to lie along the side panels, where they may be tacked in position.

At the other edge of the panels 201 to 205 are other end flaps and gussets 210' to 214 respectively which correspond generally to flaps and gussets 206 to 210 but which, in flaps 210' and 211, are slit so as to form an openable access flap for the user of the pack to gain access to its contents.

Flap 210' is interrupted by parallel cuts 215 which start just short of the free edge of the flap and extend into the main front panel 201 to a narrow bridge 216. A U-shaped cut 217 extends from one bridge to the other in the main panel 201.

In end flap 211 parallel cuts 218 extend to the potential fold line which divides panel 202 from flap 211 being there brought round in a J form at 219.

Adjacent to the extreme edge of the flap 211 are bridges 220 and beyond bridges 220 short final cuts 221 co-linear with cuts 218 and extending to the free edge of the flap 211.

Figure 21:
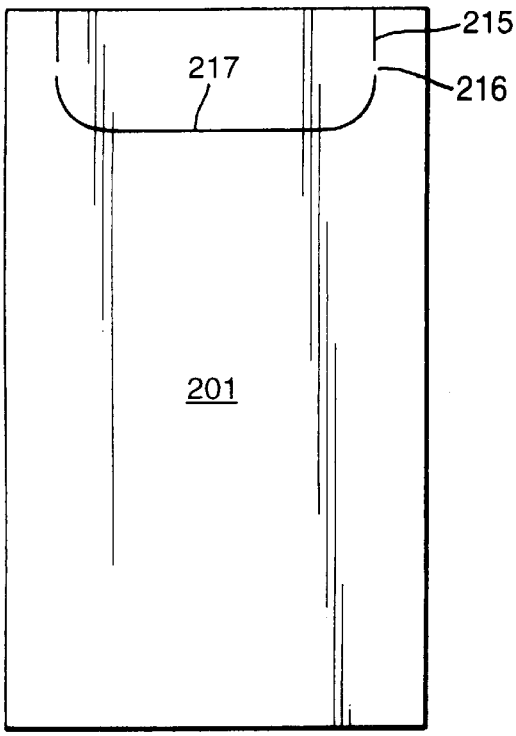
FIG. 21 shows a front view of the fourth embodiment when made up into a container.

FIG. 21 shows how the main panel 201 and the cuts 215 and 217 and bridges 216 may appear when the pack is made up. Of course, since the pack is resealable the cuts will not be visible since they will be overlaid by the resealable permanently adhesive layer label. Furthermore, the pack may be contained within an outer carton of any suitable type and/or be overwrapped.

Figure 22:
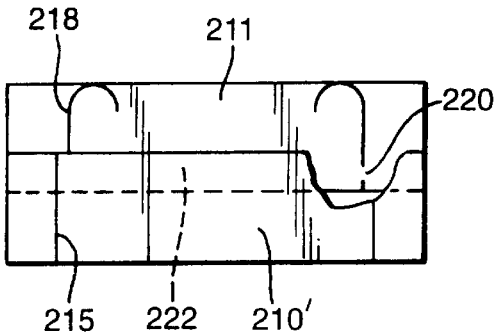
FIG. 22 shows a top plan view of the fourth embodiment when made up into a container, with a small portion cut away.

FIG. 22 shows a top view of the barrier enclosure when made up around a charge, flap 210' having been heat sealed in the region 222 over flap 211. It can be seen that the spacing apart of cuts 215 is slightly greater than that of cuts 218 so that they do not coincide in the made-up pack, there thus being continuity of barrier action. Flap 210' has been cut away somewhat to show the position of bridge 220 between cuts 218 and 221.

Figure 23:
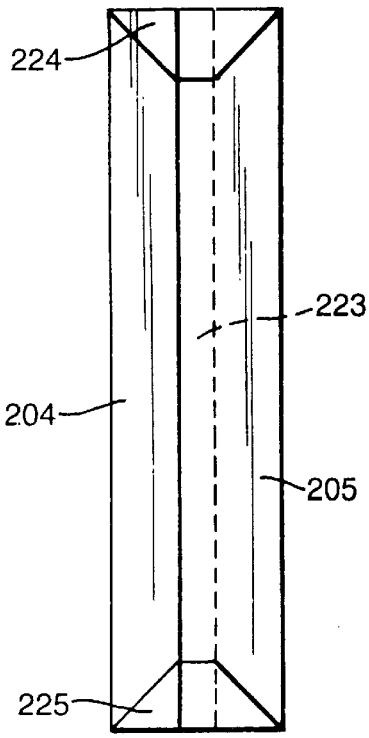
FIG. 23 shows one side view of the fourth embodiment when made up into a container.

FIG. 23 shows a side seam heat sealed region 223 between side flaps 204 and 205, with gussets 209, 210, 213, 214 forming folds 224, 225 at the top and bottom ends of that minor edge of the pack.

Figure 24:
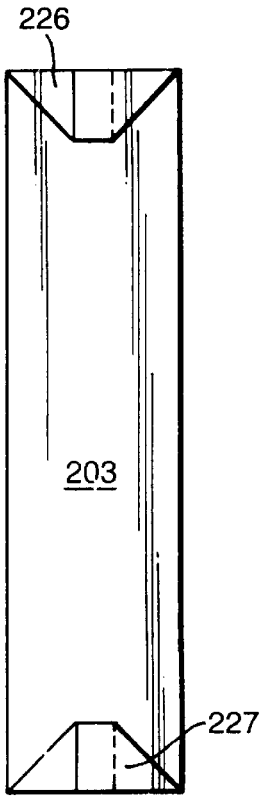
FIG. 24 shows the other side view of the fourth embodiment when made up into a container.

The opposite minor edge as seen in FIG. 24 shows the continuity of the barrier material over the edge the grocer's folds 226, 227 formed by gussets 208 and 212.

In the fifth embodiment of blank, seen in FIGS. 25 to 29, different folding means are provided, giving a cleaner effect to the side walls of the made-up pack but somewhat restricting the width available for the formation of an access flap.

In this embodiment, blank main panels 230 and 231 are front and back panels respectively and are linked by side panel 232 which is to extend continuously over one minor side edge of the charge of smoking articles and any inner frame. In the made-up pack panels 233 and 234 overlap and are sealed to each other on the opposite minor side edge.

End flaps 235 to 239 are respectively joined to panels 230 to 234 with potential fold lines being indicated in dotted lines. In particular, diagonal fold lines 240 interrupt the more major of the end flaps, namely flaps 235 and 236.

At the other edge of the main panels 230 to 234 are end flaps 241 to 245 respectively corresponding generally to flaps 235 to 239, and with fold lines 246 corresponding generally to fold lines 240.

However, as in the fourth embodiment, the major end flaps 241 and 242 are interrupted by cut lines which are to define an access flap into a sealed enclosure formed by this blank around a charge of cigarettes. Cuts 247 run parallel across flap 241 from closely adjacent its free edge into the main panel 230 to pips 248 (otherwise referred to as interruptions or bridges) from one to the other of which runs a U-shaped cut 249 in the main panel.

On end flap 242 are J-shaped cuts 250 extending from near the free edge of the flap to its potential fold line with panel 231, and leading to bridges 251 adjacent to which short cuts 252 lead to the free edge of the flap.

Figure 25:
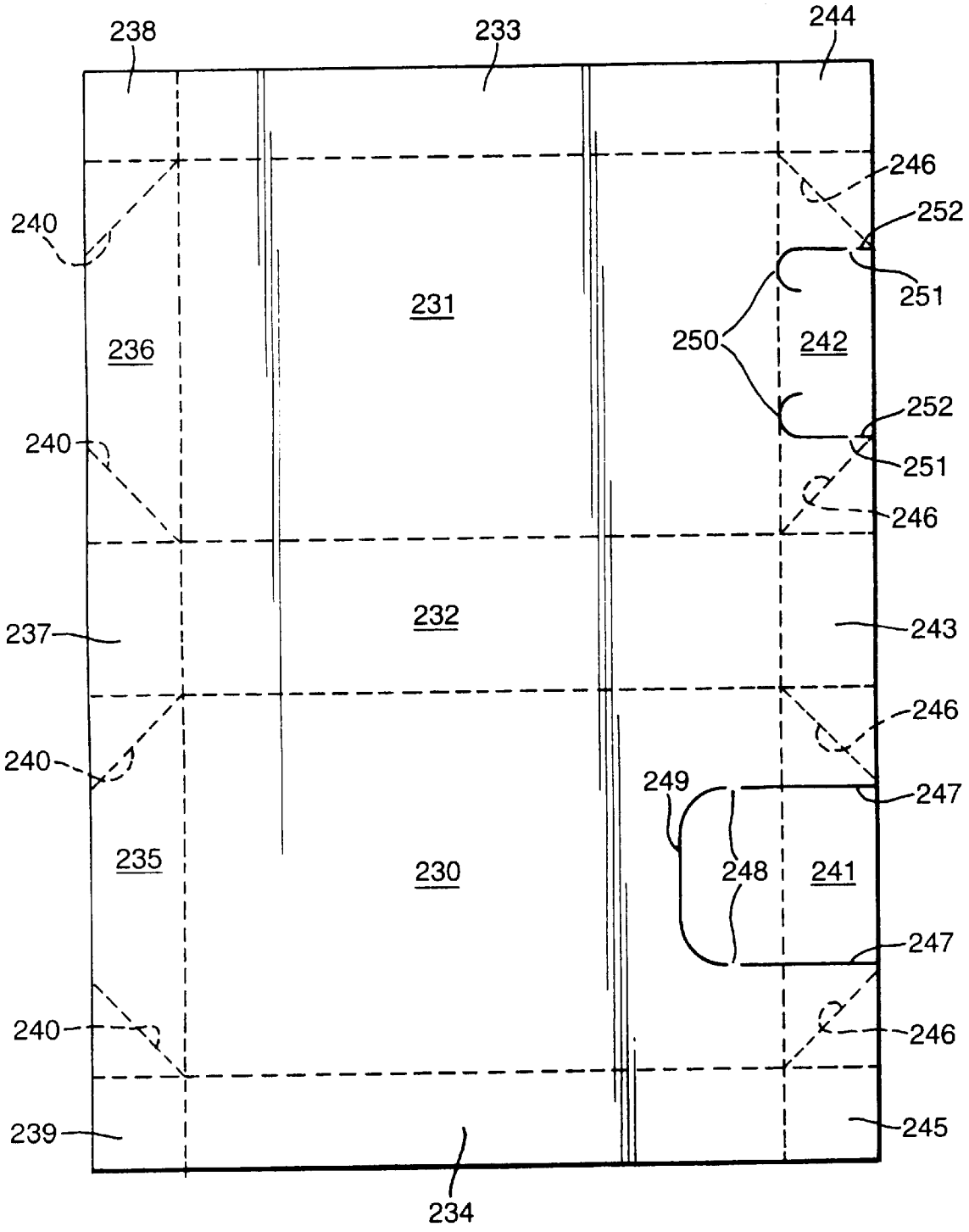
FIG. 25 shows a fifth embodiment of cut blank of barrier material.
Figure 26:
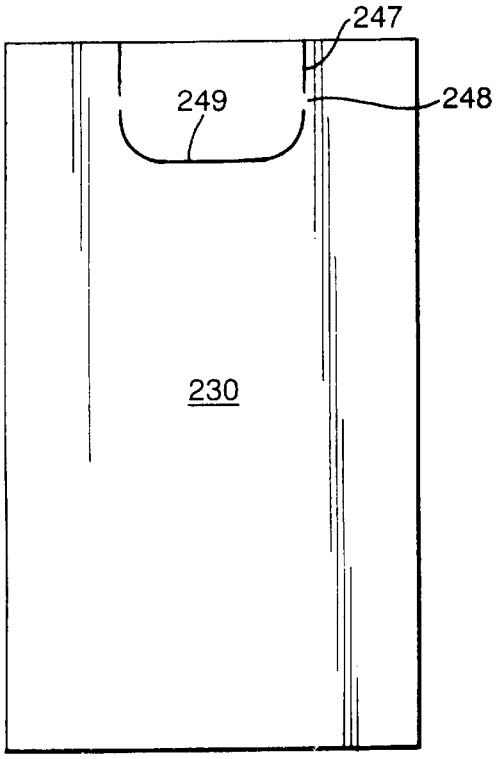
FIG. 26 shows a front view of the fifth embodiment when made up into a container.
Figure 27:
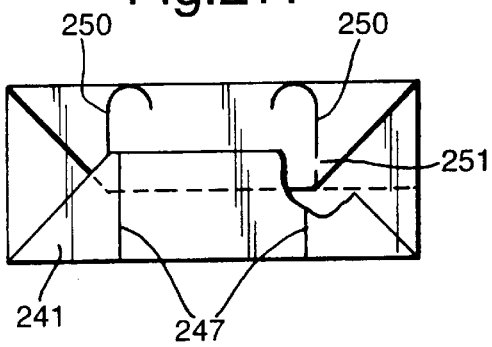
FIG. 27 shows a top plan view of the fifth embodiment when made up into a container, with a small portion cut away.

FIG. 26 shows a front view of the blank of FIG. 25 made up to a carton (otherwise referred to as a pack or a package), and FIG. 27 a top view of the carton where it is to be noted that cuts 247 and 250 do not coincide, although in contrast to the fourth embodiment cuts 250 are further apart than are cuts 247. The drawing has a small relief in flap 241 so that a bridge 251 in a cut 250 can be seen.

Figure 28:
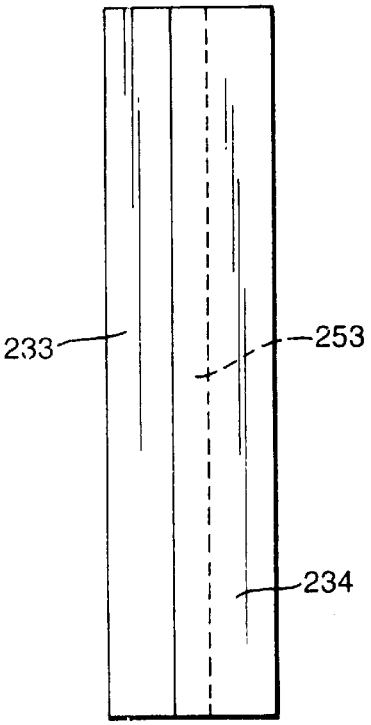
FIG. 28 shows one side view of the fifth embodiment when made up into a container.
Figure 29:
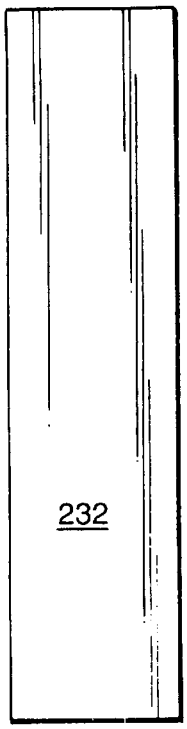
FIG. 29 shows a second side view of the fifth embodiment when made up into a container.

FIG. 28 shows the side seam 253 formed between panels 233 and 234 and FIG. 29 shows panel 232 on the other minor side of the charge. The clean effect on the sides can be noted, this being due to the formation of folds only on the top and bottom minor ends of the carton.

Figure 30:
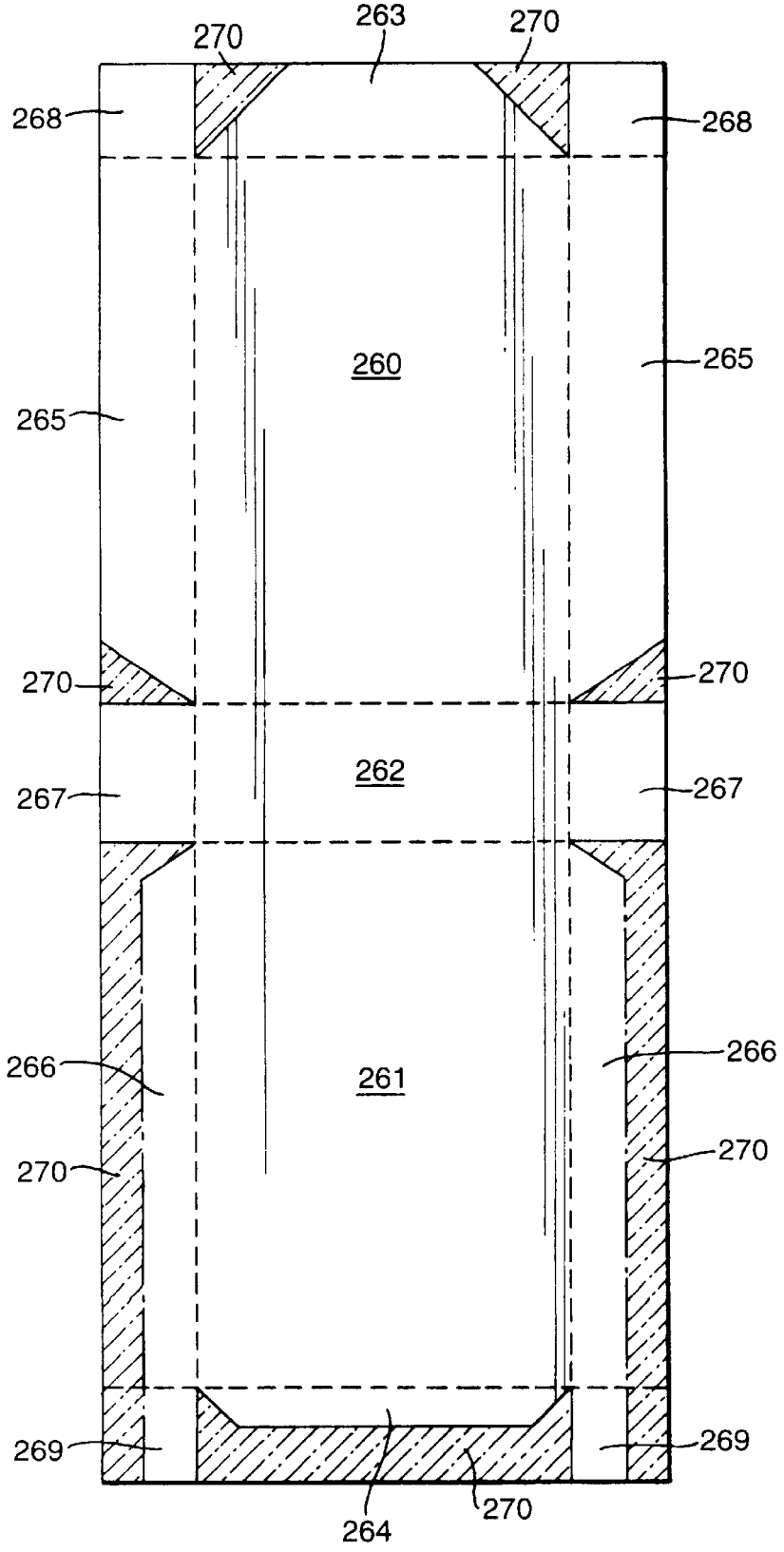
FIG. 30 shows heat-sealable areas on an inner face of a barrier blank.
Figure 31:
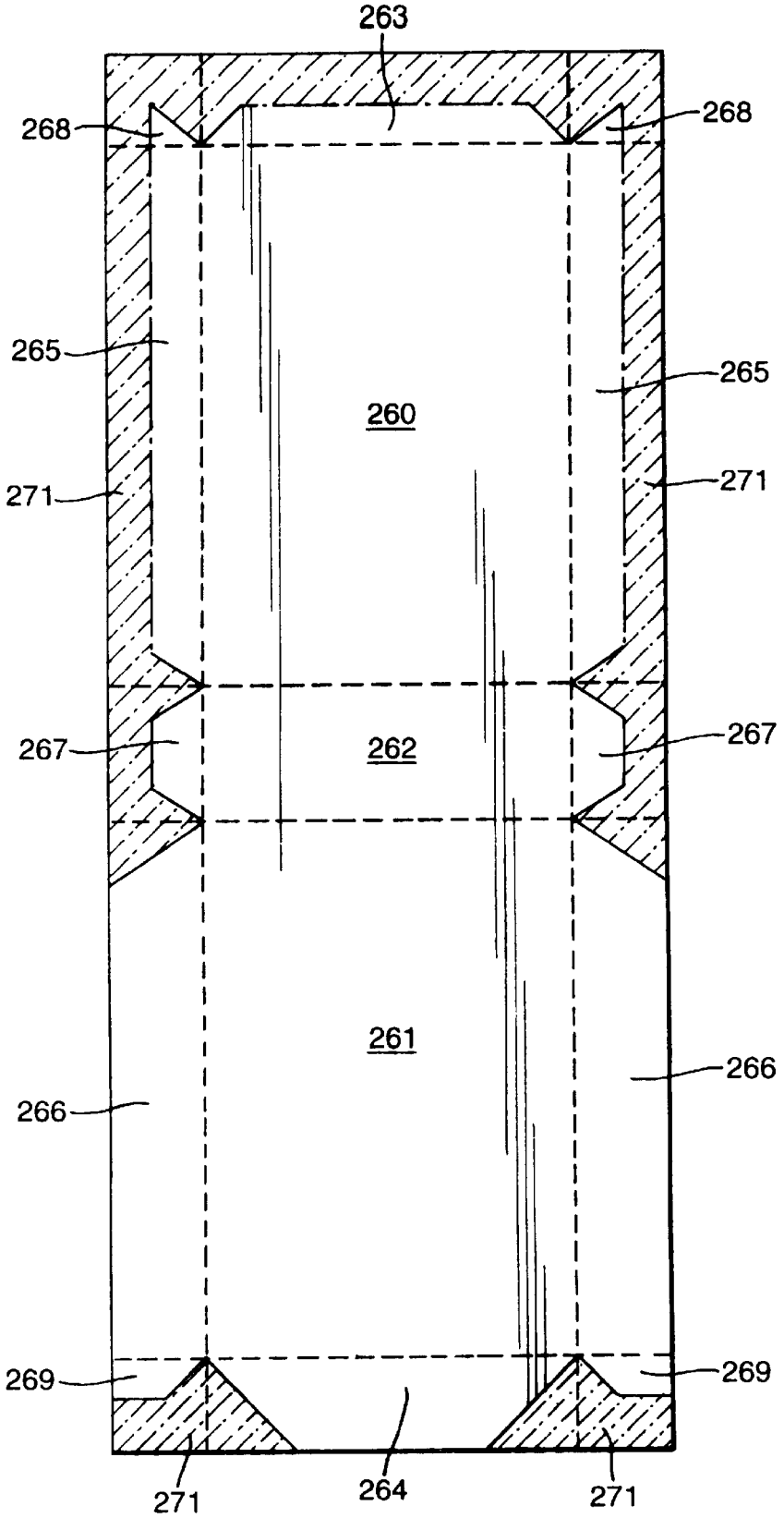
FIG. 31 shows heat-sealable areas on an outer face of a barrier blank.

Further embodiments of barrier layer blank are seen in FIGS. 30 and 31. The outline of these is schematic only—they may, for example, be any of the specific forms of blank described above, where the barrier is continuous over one minor end of the carton and inner frame, and an actual or potential access aperture will be formed in them.

In FIGS. 30 and 31 major panels 260, 261 are joined by base panel 262 and lead to top flaps 263, 264. Side and corner flaps 265 to 269 are disposed along each side of the panels and flaps 260 to 264.

Cross-hatching shows areas 270 on the face (FIG. 30) destined to be inner and 271 (FIG. 31) on the face destined to be outer in the made-up pack, which are areas of heat-sealable lacquer or glue; alternatively heat-sealable areas of a plastics composition of the barrier material itself complement each other to form a continuous seal around all seams and folds of the sealed barrier enclosure.

What is claimed is:

1. A pack of smoking articles, having two major faces, two side walls, and top and bottom end walls, said pack comprising:

a sealed enclosure of a layer of barrier material around a charge of smoking articles, an access aperture being defined in the barrier material layer, said aperture extending from said top end wall into one of said major faces of said pack, a cover layer extending over said aperture and extending beyond the periphery of said aperture, said cover layer comprising a permanently tacky surface engageable with said barrier material layer adjacent to said periphery of said aperture beyond said aperture, whereby, after opening of said aperture said enclosure can be resealed by re-engaging said permanently tacky surface with said barrier material layer adjacent to said periphery beyond said aperture;

and a frame inside said enclosure and outside said charge, said frame comprising at least a major panel, which major panel is at said one of said major faces of said pack, two side panels at respective side walls of said pack and two top flaps at respective ends of said top end wall of said pack, edge portions of said major panel and said top flaps providing reaction surfaces against the resealing pressure exerted adjacent to said periphery of said aperture when said cover layer is brought into resealing re-engagement with said barrier material layer.

2. A pack according to claim 1, wherein each of said top flaps of said frame is attached to a respective one of said side panels at the upper end of the said side panel.

3. A pack according to claim 1, wherein said frame is bevel edged.

4. A pack according to claim 1, wherein said frame comprises rounded sides.

5. A pack according to claim 1, wherein said frame comprises a bottom panel at the bottom end wall of said pack.

6. A pack according to claim 1, said pack being contained in a rigid carton.

7. A pack according to claim 6, wherein said rigid carton comprises a flip-top lid, the arrangement being such that opening of said lid provides access to said aperture of said pack and to said cover layer.

8. A pack according to claim 6, wherein said rigid carton is a Laubé box.

9. A pack according to claim 6, wherein said rigid carton is a shell and slide carton.

10. A pack of smoking articles, having two major faces, two side walls, and top and bottom end walls, said pack comprising:

a sealed enclosure of a layer of barrier material around a charge of smoking articles, an access aperture being defined in the barrier material layer, said aperture extending from said top end wall into one of said major faces of said pack, a cover layer extending over said aperture and extending beyond the periphery of said aperture, said cover layer comprising a permanently tacky surface engageable with said barrier material layer adjacent to said periphery of said aperture beyond said aperture, whereby, after opening of said aperture said enclosure can be resealed by re-engaging said permanently tacky surface with said barrier material layer adjacent to said periphery beyond said aperture;

and a frame inside said enclosure and outside said charge, said frame comprising at least a major panel, which major panel is at said one of said major faces of said pack, two side panels at respective side walls of said pack and two top flaps at respective ends of said top end wall of said pack, edge portions of said major panel and said top flaps providing reaction surfaces against the resealing pressure exerted adjacent to said periphery of said aperture when said cover layer is brought into resealing re-engagement with said barrier material layer, wherein each of said top flaps of said frame is attached to a respective one of said side panels at the upper end of the said side panel and further wherein said pack is contained in a rigid carton comprising a flip-top lid, the arrangement being such that opening of said lid provides access to said aperture of said pack and to said cover layer.

11. A pack according to claim 10, wherein said frame is bevel edged.

12. A pack according to claim 10, wherein said frame comprises rounded sides.

13. A pack according to claim 10, wherein said frame comprises a bottom panel at the bottom end wall of said pack.

14. A pack of smoking articles, having two major faces, two side walls, and top and bottom end walls, said pack comprising:

a scaled enclosure of a layer of barrier material around a charge of smoking articles, an access aperture being defined in the barrier material layer, said aperture extending from said top end wall into one of said major faces of said pack, a cover layer extending over said aperture and extending beyond the periphery of said aperture, said cover layer comprising a permanently tacky surface engageable with said barrier material layer adjacent to said periphery of said aperture beyond said aperture, whereby, after opening of said aperture said enclosure can be resealed by re-engaging said permanently tacky surface with said barrier material layer adjacent to said periphery beyond said aperture;

and a frame inside said enclosure and outside said charge, said frame comprising at least a major panel, which major panel is at said one of said major faces of said pack, two side panels at respective side walls of said pack and two top flaps at respective ends of said top end wall of said pack, edge portions of said major panel and said top flaps providing reaction surfaces against the resealing pressure exerted adjacent to said periphery of said aperture when said cover layer is brought into resealing re-engagement with said barrier material layer, wherein said pack is contained in a rigid carton wherein said rigid card carton comprises a flip-top lid, the arrangement being such that opening of said lid provides access to said aperture of said pack and to said cover layer, and further wherein said frame comprises rounded sides.

15. A pack according to claim 14, wherein each of said top flaps of said frame is attached to a respective one of said side panels at the upper end of the said side panel.

16. A pack according to claim 14, wherein said frame comprises a bottom panel at the bottom end wall of said pack.

17. A pack of smoking articles, having two major faces, two side walls, and top and bottom end walls, said pack comprising:

a sealed enclosure of a layer of barrier material around a charge of smoking articles, an access aperture being defined in the barrier material layer, said aperture extending from said top end wall into one of said major faces of said pack, a cover layer extending over said aperture and extending beyond the periphery of said aperture, said cover layer comprising a permanently tacky surface engageable with said barrier material layer adjacent to said periphery of said aperture beyond said aperture, whereby, after opening of said aperture sa id enclosure can be resealed by re-engaging said permanently tacky surface with said barrier material layer adjacent to said periphery beyond said aperture; and a frame inside said enclosure and outside said charge, said frame comprising at least a major panel, which major panel is at said one of said major faces of said pack, and two top flaps at respective ends of said top end wall of said pack, edge portions of said major panel and said top flaps providing reaction surfaces against the resealing pressure exerted adjacent to said periphery of said aperture when said cover layer is brought into resealing re-engagement with said barrier material layer.

* * * * *